US006803355B1

(12) United States Patent
Panandiker et al.

(10) Patent No.: US 6,803,355 B1
(45) **Date of Patent: *Oct. 12, 2004**

(54) LAUNDRY DETERGENT COMPOSITIONS WITH FABRIC ENHANCING COMPONENT

(75) Inventors: Rajan Keshav Panandiker, West Chester, OH (US); Jennifer Leupin Moe, West Chester, OH (US); William Conrad Wertz, West Harrison, IN (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/890,674

(22) PCT Filed: Feb. 9, 2000

(86) PCT No.: PCT/US00/03472

§ 371 (c)(1),
(2), (4) Date: Aug. 3, 2001

(87) PCT Pub. No.: WO00/47705

PCT Pub. Date: Aug. 17, 2000

Related U.S. Application Data

(63) Continuation-in-part of application No. 09/202,387, filed on Sep. 15, 1998, now Pat. No. 6,384,011.

(60) Provisional application No. 60/119,569, filed on Feb. 10, 1999.

(51) Int. Cl.[7] ..... C11D 3/22; C11D 3/26; C11D 3/37

(52) U.S. Cl. ..... 510/473; 510/302; 510/320; 510/332; 510/350; 510/500

(58) Field of Search ..... 510/302, 320, 510/332, 350, 473, 500

(56) References Cited

U.S. PATENT DOCUMENTS

| | | | | | |
|---|---|---|---|---|---|
| 6,025,322 | A | * | 2/2000 | Boeckh et al. | 510/516 |
| 6,384,011 | B1 | * | 5/2002 | Leupin et al. | 510/473 |
| 6,472,364 | B1 | * | 10/2002 | Heltovics | 510/500 |
| 6,579,840 | B1 | * | 6/2003 | Heltovics | 510/327 |

FOREIGN PATENT DOCUMENTS

| | | | | |
|---|---|---|---|---|
| DE | 196 43 281 A1 | | 4/1998 | |
| DE | 19643281 | * | 4/1998 | C11D/3/42 |
| EP | WO 98/29528 | * | 7/1998 | C11D/3/22 |
| EP | WO 99/14301 | * | 3/1999 | C11D/3/37 |
| EP | WO 00/47705 | * | 8/2000 | C11D/3/37 |
| WO | WO 98/29528 | | 7/1998 | |
| WO | WO 99/14295 | | 3/1999 | |
| WO | WO 99/14299 | | 3/1999 | |
| WO | WO 00/22078 | | 4/2000 | |

* cited by examiner

*Primary Examiner*—Brian P. Mruk
(74) *Attorney, Agent, or Firm*—Kim W. Zerby; Steven W. Miller

(57) ABSTRACT

Detergent compositions are formulated with a mixture of hydrophobically modified cellulose polymers or oligomers and cyclic amine based polymers or oligomers. The cellulose/amine mixture maintains the integrity and appearance of fabrics laundered in the compositions. Dye maintenance and anti-pilling benefits are provided. The compositions are provided in containers which alert the user of the benefits provided by the compositions.

18 Claims, No Drawings

LAUNDRY DETERGENT COMPOSITIONS WITH FABRIC ENHANCING COMPONENT

CROSS-REFERENCE TO RELATED APPLICATION

This application is a continuation-in-part of U.S. application, Ser. No. 09/202,387, PCT filing Sep. 15, 1998, now U.S. Pat. No. 6,384,011 B1, granted May 7, 2002. This application claims benefit to U.S. Provisional Application 60,119569 filed Feb. 10, 1999.

TECHNICAL FIELD

The present invention relates to compositions, in either liquid or granular form, for use in laundry applications, wherein the compositions comprise certain fabric enhancing components, which can be, for example, a cyclic amine based polymer, oligomer or copolymer material, hydrophobically modified carboxy methyl cellulose and mixtures thereof. Additionally, a contain for such compositions is provided.

BACKGROUND OF THE INVENTION

It is, of course, well known that alternating cycles of using and laundering fabrics and textiles, such as articles of worn clothing and apparel, will inevitably adversely affect the appearance and integrity of the fabric and textile items so used and laundered. Fabrics and textiles simply wear out over time and with use. Laundering of fabrics and textiles is necessary to remove soils and stains which accumulate therein and thereon during ordinary use. However, the laundering operation itself, over many cycles, can accentuate and contribute to the deterioration of the integrity and the appearance of such fabrics and textiles.

Deterioration of fabric integrity and appearance can manifest itself in several ways. Short fibers are dislodged from woven and knit fabric/textile structures by the mechanical action of laundering. These dislodged fibers may form lint, fuzz or "pills" which are visible on the surface of fabrics and diminish the appearance of newness of the fabric. Further, repeated laundering of fabrics and textiles, especially with bleach-containing laundry products, can remove dye from fabrics and textiles and impart a faded, worn out appearance as a result of diminished color intensity, and in many cases, as a result of changes in hues or shades of color.

Given the foregoing, there is clearly an ongoing need to identify materials which could be added to laundry detergent products that would associate themselves with the fibers of the fabrics and textiles laundered using such detergent products and thereby reduce or minimize the tendency of the laundered fabric/textiles to deteriorate in appearance. Any such detergent product additive material should, of course, be able to benefit fabric appearance and integrity without unduly interfering with the ability of the laundry detergent to perform its fabric cleaning function.

Moreover, there is a need for a container for such products. The container should not only store the composition but it should also convey to the consumer the benefits of this new product.

SUMMARY OF THE INVENTION

The present invention is directed to a detergent composition comprising:

a) from about 1% to about 80% by weight of surfactants selected from the group consisting of nonionic, anionic, cationic, amphoteric zwitterionic surfactants and mixtures thereof; and b) from about 0.01% to about 5.0%, preferably from about 0.1% to about 4.0%, by weight of a fabric enhancing component selected from the group consisting of cyclic amine based polymers, oligomers or copolymers, hydrophobically modified cellulosic based polymers or oligomers, and mixtures thereof.

Further, the detergent composition is contained within an interior chamber of a container, the container further comprising an exterior surface wherein the exterior surface contains a description of the composition comprising language selected from the group consisting of: helps clothes look healthier, helps stop wear before it starts, maintains the appearance of clothes, helps prevent clothes from looking worn out, strengthens while it cleans for better looking clothes, strengthens threads so clothes look better, helps prevent clothes from looking worn, helps prevent wear and tear in the washer that can make clothes look old, helps keep clothes from aging, helps clothes come out of the washer looking as good as when they went in, helps preserve the fabric integrity of clothes, strengthens threads from the inside out for better looking clothes, extends the life of clothes, is like a vitamin for clothes, works like an anti-aging product on clothes, is like calcium for clothes, is like a supplement for clothes, after just 10 washes clothes look better than they would if you washed them with other detergents, fortifies threads for healthier looking clothes, helps prevent clothes from looking old before their time, is like stopping time for your clothes so they stay looking good.

The cyclic amine based polymer, oligomer or copolymer materials which are suitable for use in laundry operations and provide the desired fabric appearance and integrity benefits can be characterized by the following general formula:

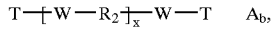

wherein;

each T is independently selected from the group consisting of H, $C_1$–$C_{12}$ alkyl, substituted alkyl, $C_7$–$C_{12}$ alkylaryl, —$(CH_2)_nCOOM$, —$(CH_2)_nSO_3M$, $CH_2CH(OH)SO_3M$, —$(CH_2)_nOSO_3M$,

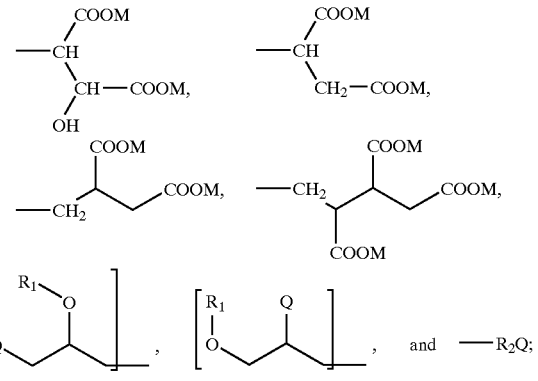

wherein W comprises at least one cyclic constituent selected from the group consisting of:

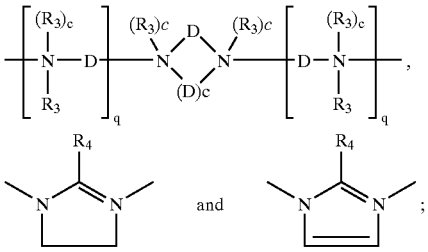

in addition to the at least one cyclic constituent, W may also comprise an aliphatic or substituted aliphatic moiety of the general structure;

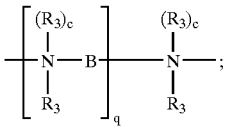

each B is independently $C_1$–$C_{12}$ alkylene, $C_1$–$C_{12}$ substituted alkylene, $C_3$–$C_{12}$ alkenylene, $C_8$–$C_{12}$ dialkylarylene, $C_8$–$C_{12}$ dialkylarylenediyl, and —$(R_5O)_nR_5$—;

each D is independently $C_2$–$C_6$ alkylene;

each Q is independently selected from the group consisting of hydroxy, $C_1$–$C_{18}$ alkoxy, $C_2$–$C_{18}$ hydroxyalkoxy, amino, $C_1$–$C_{18}$ alkylamino, dialkylamino, trialkylamino groups, heterocyclic monoamino groups and diamino groups;

each $R_1$ is independently selected from the group consisting of H, $C_1$–$C_8$ alkyl and $C_1$–$C_8$ hydroxyalkyl;

each $R_2$ is independently selected from the group consisting of $C_1$–$C_{12}$ alkylene, $C_1$–$C_{12}$ alkenylene, —$CH_2$—$CH(OR_1)$—$CH_2$, $C_8$–$C_{12}$ alkarylene, $C_4$–$C_{12}$ dihydroxyalkylene, poly($C_2$–$C_4$ alkyleneoxy)alkylene, $H_2CH(OH)CH_2OR_2OCH_2CH(OH)CH_2$—, and $C_3$–$C_{12}$ hydrocarbyl moieties;

provided that when $R_2$ is a $C_3$–$C_{12}$ hydrocarbyl moiety the hydrocarbyl moiety can comprise from about 2 to about 4 branching moieties of the general structure:

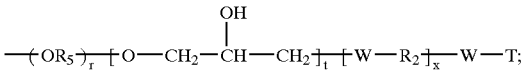

each $R_3$ is independently selected from the group consisting of H, O, $R_2$, $C_1$–$C_{20}$ hydroxyalkyl, $C_1$–$C_{20}$ alkyl, substituted alkyl, $C_6$–$C_{11}$ aryl, substituted aryl, $C_7$–$C_{11}$alkylaryl, $C_1$–$C_{20}$ aminoalkyl, —$(CH_2)_h$COOM, —$(CH_2)_hSO_3M$, $CH_2CH(OH)SO_3M$, —$(CH_2)_hOSO_3M$,

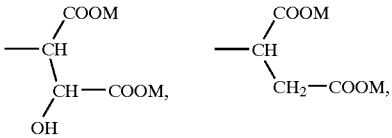

-continued

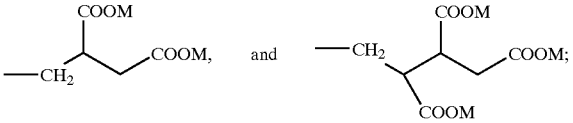

each $R_4$ is independently selected from the group consisting of H, $C_1$–$C_{22}$ alkyl, $C_1$–$C_{22}$ hydroxyalkyl, aryl and $C_7$–$C_{22}$ alkylaryl;

each $R_5$ is independently selected from the group consisting of $C_2$–$C_8$ alkylene, $C_2$–$C_8$ alkyl substituted alkylene; and A is a compatible monovalent or di or polyvalent anion;

M is a compatible cation;

b=number necessary to balance the charge;

each x is independently from 3 to about 1000;

each c is independently 0 or 1;

each h is independently from about 1 to about 8;

each q is independently from 0 to about 6;

each n is independently from 1 to about 20;

each r is independently from 0 to about 20; and each t is independently from 0 to 1.

Cellulosic based polymer or oligomer materials which are suitable for use in laundry operations and provide the desired fabric appearance and integrity benefits can be characterized by the following general formula:

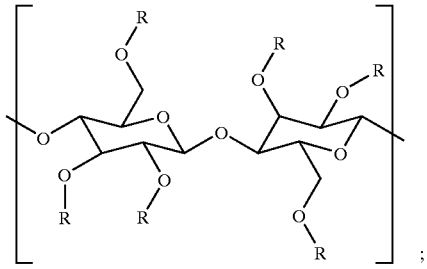

wherein each R is selected from the group consisting of $R_2$, $R_C$, and

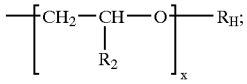

wherein:

each $R_2$ is independently selected from the group consisting of H and $C_1$–$C_4$ alkyl;

each $R_C$ is

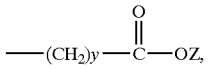

wherein each Z is independently selected from the group consisting of M, $R_2$, $R_C$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl hydroxyalkyl, $C_1$–$C_{20}$ alkoxy-2-hydroxyalkyl, $C_7$–$C_{20}$ aklylaryloxy-2-hydroxyalkyl, $(R_4)_2$N-alkyl, $(R_4)_2$N-2-hydroxyalkyl, $(R_4)_3$N-alkyl, $(R_4)_3$N-2-hydroxyalkyl, $C_6$–$C_{12}$ aryloxy-2-hydroxyalkyl,

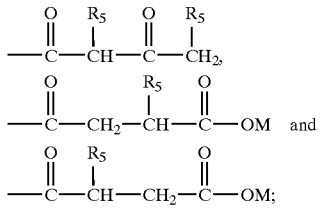

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminoalkyl, piperidinoalkyl, morpholinoalkyl, cycloalkylaminoalkyl and hydroxyalkyl;

each $R_5$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $(R_4)_2$N-alkyl, and $(R_4)_3$N-alkyl;

wherein:

M is a suitable cation selected from the group consisting of Na, K, 1/2Ca, and 1/2Mg;

each x is from 0 to about 5;

each y is from about 1 to about 5; and provided that:

the Degree of Substitution for group $R_H$ is between about 0.001 and 0.1, more preferably between about 0.005 and 0.05, and most preferably between about 0.01 and 0.05;

the Degree of Substitution for group $R_C$ wherein Z is H or M is between about 0.2 and 2.0, more preferably between about 0.3 and 1.0, and most preferably between about 0.4 and 0.7;

if any $R_H$ bears a positive charge, it is balanced by a suitable anion; and two $R_4$'s on the same nitrogen can together form a ring structure selected from the group consisting of piperidine and morpholine.

The cyclic amine based polymer, oligomer or copolymer materials defined above can be used, along with the hydrophobically modified cellulosic based polymers or oligomers, as a washing solution additive in either granular or liquid form. Alternatively, they can be admixed to granular detergents, dissolved in liquid detergent compositions or added to a fabric softening composition.

The laundry detergent compositions herein comprise from about 1% to 80% by weight of a detersive surfactant, from about 0.01% to 80% by weight of an organic or inorganic detergency builder and from about 0.01% to 5% by weight of the fabric enhancing component of the present invention. The detersive surfactant and detergency builder materials can be any of those useful in conventional laundry detergent products.

Aqueous solutions of the fabric enhancing component of the subject invention comprise from about 0.01% to 80% by weight of cyclic amine based polymers, oligomers or copolymers, hydrophobically modified cellulosic based polymers or oligomers and mixtures thereof dissolved in water and other ingredients such as stabilizers and pH adjusters.

In its method aspect, the present invention relates to the laundering or treating of fabrics and textiles in aqueous washing or treating solutions formed from effective amounts of the detergent compositions described herein, or formed from the individual components of such compositions. Laundering of fabrics and textiles in such washing solutions, followed by rinsing and drying, imparts fabric appearance benefits to the fabric and textile articles so treated. Such benefits can include improved overall appearance, pill/fuzz reduction, antifading, improved abrasion resistance, and/or enhanced softness.

DETAILED DESCRIPTION OF THE INVENTION

As noted, when fabric or textiles are laundered in wash solutions which comprise the fabric enhancing component, the present invention fabric appearance and integrity are enhanced. The fabric enhancing component, that is, the cyclic amine based polymers, oligomers or copolymers and hydrophobically modified cellulosic based polymers or oligomers can be added to wash solutions by incorporating them into a detergent composition, a fabric softener or by adding them separately to the washing solution.

The cyclic amine based polymers, oligomers or copolymers and hydrophobically modified cellulosic based polymers or oligomers are described herein primarily as liquid or granular detergent additives but the present invention is not meant to be so limited. Likewise, the detergent containers of the present invention include any appropriate type of detergent composition container. Non-limiting examples of such containers include boxes, bags and bottles, which can be made from paper, plastic, cardboard, laminates, etc. Those skilled in the art will know what materials of construction and types of materials are appropriate for the detergent compositions of this invention.

The cyclic amine based polymers, oligomers or copolymers and hydrophobically modified cellulosic based polymers or oligomers, detergent composition components, optional ingredients for such compositions and methods of using such compositions, are described in detail below. All percentages are by weight unless other specified.

A) Cyclic Amine Based Polymer, Oligomer or Copolymer Materials

The compositions of the present invention can comprise one or more cyclic amine based polymer, oligomer or copolymer. Such materials have been found to impart a number of appearance benefits to fabrics and textiles laundered in aqueous washing solutions formed from detergent compositions which contain these materials. Such fabric appearance benefits can include, for example, improved overall appearance of the laundered fabrics, reduction of the formation of pills and fuzz, protection against color fading, improved abrasion resistance, etc. The cyclic amine based fabric treatment materials used in the compositions and methods herein can provide such fabric appearance benefits with acceptably little or no loss in cleaning performance provided by the laundry detergent compositions into which such materials are incorporated.

The cyclic amine based polymer, oligomer or copolymer component of the compositions herein may comprise combinations of these cyclic amine based materials. For example, a mixture of piperadine and epihalohydrin condensates can be combined with a mixture of morpholine and epihalohydrin condensates to achieve the desired fabric treatment results. Moreover, the molecular weight of cyclic amine based fabric treatment materials can vary within the mixture as is illustrated in the Examples below.

As will be apparent to those skilled in the art, an oligomer is a molecule consisting of only a few monomer units while polymers comprise considerably more monomer units. For the present invention, oligomers are defined as molecules having an average molecular weight below about 1,000 and polymers are molecules having an average molecular weight of greater than about 1,000. Copolymers are polymers or oligomers wherein two or more dissimilar monomers have been simultaneously or sequentially polymerized. Copolymers of the present invention can include, for example, polymers or oligomers polymerized from a mixture of a primary cyclic amine based monomer, e.g., piperadine, and a secondary cyclic amine monomer, e.g., morpholine.

The fabric enhancing component comprising cyclic amine based polymers, oligomers or copolymers, hydrophobically modified cellulosic based polymers or oligomers and mixtures thereof of the detergent compositions herein will generally comprise from about 0.01% to about 5% by the weight of the detergent composition. More preferably, the fabric enhancing component will comprise from about 0.1% to about 4% by weight of the detergent compositions, most preferably from about 0.75% to about 3%. However, as discussed above, when used as a washing solution additive, i.e. when the fabric enhancing component is not incorporated into a detergent composition, the concentration of the fabric enhancing component can comprise from about 0.1% to about 80% by weight of the additive material.

Cyclic amine based polymer, oligomer or copolymer materials which are suitable for use in laundry operations and provide the desired fabric appearance and integrity benefits can be characterized by the general formula given in the Summary of the Invention.

Preferred compounds that fall within this general structure include compounds:

wherein each $R_1$ is H; and at least one W is selected from the group consisting of:

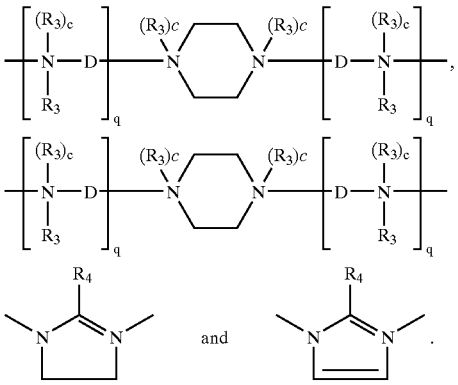

Even more preferred compounds for the fabric appearance and integrity benefits are those:

wherein each $R_1$ is H; and at least one W is selected from the group consisting of:

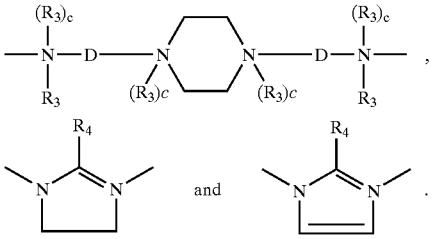

And most preferred compounds for the fabric appearance and integrity benefits are those:

wherein each $R_1$ is H; and at least one W is selected from the group consisting of:

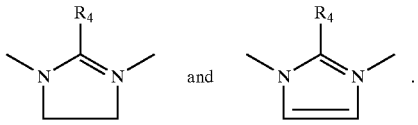

Preferred compounds to be used as the linking group $R_2$ include, but are not limited to: polyepoxides, ethylenecarbonate, propylenecarbonate, urea, α,β-unsaturated carboxylic acids, esters of α,β-unsaturated carboxylic acids, amides of α,β-unsaturated carboxylic acids, anhydrides of α,β-unsaturated carboxylic acids, di- or polycarboxylic acids, esters of di- or polycarboxylic acids, amides of di- or polycarboxylic acids, anhydrides of di- or polycarboxylic acids, glycidylhalogens, chloroformic esters, chloroacetic esters, derivatives of chloroformic esters, derivatives of chloroacetic esters, epihalohydrins, glycerol dichlorohydrins, bis-(halohydrins), polyetherdihalo-compounds, phosgene, polyhalogens, functionalized glycidyl ethers and mixtures thereof. Moreover, $R_2$ can also comprise a reaction product formed by reacting one or more of polyetherdiamines, alkylenediamines, polyalkylenepolyamines, alcohols, alkyleneglycols and polyalkyleneglycols with α,β-unsaturated carboxylic acids, esters of α,β-unsaturated carboxylic acids, amides of α,β-unsaturated carboxylic acids and anhydrides of α,β-unsaturated carboxylic acids provided that the reaction products contain at least two double bonds, two carboxylic groups, two amide groups or two ester groups.

Additionally preferred cyclic amine based polymer, oligomer or copolymer materials for use herein include adducts of two or more compositions selected from the group consisting of piperazine, piperadine, epichlorohydrin, epichlorohydrin benzyl quat, epichlorohydrin methyl quat, morpholine and mixtures thereof.

These cyclic amine based polymers can be linear or branched. One specific type of branching can be intorduced using a polyfunctional crosslinking agent. An example of one such polymer is exemplified below.

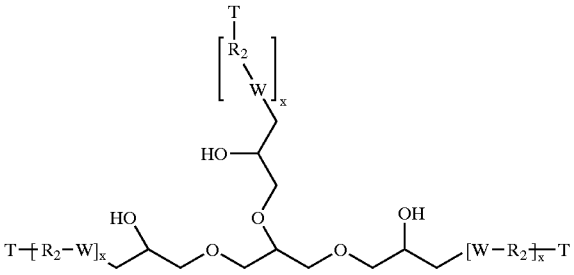

B) Hydrophobically Modified Cellulosic Based Polymers or Oligomers

The compositions of the present invention can comprises one or more cellulosic based polymer or oligomer. Such materials have been found to impart a number of appearance benefits to fabrics and textiles laundered in aqueous washing solutions formed from detergent compositions which contain such cellulosic based fabric treatment materials. Such fabric appearance benefits can include, for example, improved overall appearance of the laundered fabrics, reduction of the formation of pills and fuzz, protection against color fading, improved abrasion resistance, etc. The cellulosic based fabric treatment materials used in the compositions and methods herein can provide such fabric appearance benefits with acceptably little or no loss in cleaning performance provided by the laundry detergent compositions into which such materials are incorporated.

As will be apparent to those skilled in the art, an oligomer is a molecule consisting of only a few monomer units while polymers comprise considerably more monomer units. For the present invention, oligomers are defined as molecules having an average molecular weight below about 1,000 and polymers are molecules having an average molecular weight of greater than about 1,000. One suitable type of cellulosic based polymer or oligomer fabric treatment material for use herein has an average molecular weight of from about 5,000 to about 2,000,000, preferably from about 50,000 to about 1,000,000.

The cellulosic based fabric treatment component of the detergent compositions herein will generally comprise from about 0.1% to about 5% by the weight of the detergent composition. More preferably, such cellulosic based fabric treatment materials will comprise from about 0.5% to about 4% by weight of the detergent compositions, most preferably from about 0.75% to about 3%. However, as discussed above, when used as a washing solution additive, i.e. when the cellulosic based fabric treatment component is not incorporated into a detergent composition, the concentration of the cellulosic based component can comprise from about 0.1% to about 80% by weight of the additive material.

One suitable group of cellulosic based polymer or oligomer materials for use herein is characterized by the following formula:

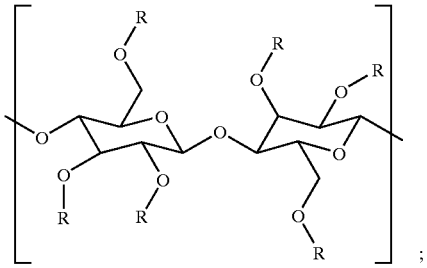

wherein each R is selected from the group consisting of $R_2$, $R_C$, and

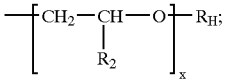

wherein:

each $R_2$ is independently selected from the group consisting of H and $C_1$–$C_4$ alkyl;

each $R_C$ is

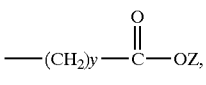

wherein each Z is independently selected from the group consisting of M, $R_2$, $R_C$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylaryloxy-2-hydroxyalkyl, $(R_4)_2N$-alkyl, $(R_4)_2N$-2-hydroxyalkyl, $(R_4)_3N$-alkyl, $(R_4)_3N$-2-hydroxyalkyl, $C_6$–$C_{12}$ aryloxy-2-hydroxyalkyl,

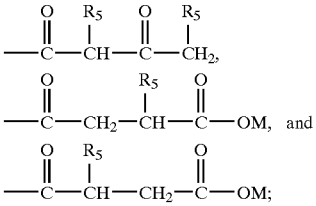

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminoalkyl, piperidinoalkyl, morpholinoalkyl, cycloalkylaminoalkyl and hydroxyalkyl;

each $R_5$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $(R_4)_2N$-alkyl, and $(R_4)_3N$-alkyl;

wherein:

M is a suitable cation selected from the group consisting of Na, K, 1/2Ca, and 1/2Mg;

each x is from 0 to about 5;

each y is from about 1 to about 5; and provided that:

the Degree of Substitution for group $R_H$ is between about 0.001 and 0.1, more preferably between about 0.005 and 0.05, and most preferably between about 0.01 and 0.05;

the Degree of Substitution for group $R_C$ wherein Z is H or M is between about 0.2 and 2.0, more preferably between about 0.3 and 1.0, and most preferably between about 0.4 and 0.7;

if any $R_H$ bears a positive charge, it is balanced by a suitable anion; and two $R_4$'s on the same nitrogen can together form a ring structure selected from the group consisting of piperidine and morpholine.

The "Degree of Substitution" for group $R_H$, which is sometimes abbreviated herein "$DS_{RH}$", means the number of moles of group $R_H$ components that are substituted per anhydrous glucose unit, wherein an anhydrous glucose unit is a six membered ring as shown in the repeating unit of the general structure above.

The "Degree of Substitution" for group $R_C$, which is sometimes abbreviated herein "$DS_{RC}$", means the number of moles of group $R_C$ components, wherein Z is H or M, that are substituted per anhydrous glucose unit, wherein an anhydrous glucose unit is a six membered ring as shown in the repeating unit of the general structure above. The requirement that Z be H or M is necessary to insure that there are a sufficient number of carboxy methyl groups such that the resulting polymer is soluble. It is understood that in addition to the required number of $R_C$ components wherein Z is H or M, there can be, and most preferably are, additional $R_C$ components wherein Z is a group other than H or M.

The production of materials according to the present invention is further defined in the Examples below.

C) Detersive Surfactant

The detergent compositions herein comprise from about 1% to 80% by weight of a detersive surfactant. Preferably such compositions comprise from about 5% to 50% by weight of surfactant. Detersive surfactants utilized can be of the anionic, nonionic, zwitterionic, ampholytic or cationic type or can comprise compatible mixtures of these types. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980. All of these patents are incorporated herein by reference. Of all the surfactants, anionics and nonionics are preferred.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Especially valuable are linear straight chain alkylbenzene sulfonates in which the average number of carbon atoms in the alkyl group is from about 11 to 13, abbreviated as $C_{11-13}$ LAS.

Preferred nonionic surfactants are those of the formula $R_1(OC_2H_4)_nOH$, wherein $R_1$ is a $C_{10}$–$C_{16}$ alkyl group or a $C_8$–$C_{12}$ alkyl phenyl group, and n is from 3 to about 80. Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

Additional suitable surfactants, including polyhydroxy fatty acid amides and amine based surfactants, are disclosed in co-pending PCT Application WO98/19143. Published Mar. 25, 1999, entitled Laundry Detergent with Cyclic Amine Based Polymers to Provide Appearance and Integrity Benefits to Fabrics Laundered Therewith, which was filed on Sep. 15, 1997, in the name of Panandiker et al. [P&G Case No. 6834]. The entire disclosure of the Panandiker et al. reference is incorporated herein by reference.

D) Detergent Builder

The detergent compositions herein may also comprise from about 0.1% to 80% by weight of a detergent builder. Preferably such compositions in liquid form will comprise from about 1% to 10% by weight of the builder component. Preferably such compositions in granular form will comprise from about 1% to 50% by weight of the builder component. Detergent builders are well known in the art and can comprise, for example, phosphate salts as well as various organic and inorganic nonphosphorus builders.

Water-soluble, nonphosphorus organic builders useful herein include the various alkali metal, ammonium and substituted ammonium polyacetates, carboxylates, polycarboxylates and polyhydroxy sulfonates. Suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. Particularly preferred polycarboxylate builders are the oxydisuccinates and the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Examples of suitable nonphosphorus, inorganic builders include the silicates, aluminosilicates, borates and carbonates. Particularly preferred are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Also preferred are aluminosilicates including zeolites. Such materials and their use as detergent builders are more fully discussed in Corkill et al., U.S. Pat. No. 4,605,509, the disclosure of which is incorporated herein by reference. Also discussed in U.S. Pat. No. 4,605,509 are crystalline layered silicates which are suitable for use in the detergent compositions of this invention.

E) Optional Detergent Ingredients

In addition to the surfactants, builders and fabric enhancing component hereinbefore described, the detergent compositions of the present invention can also include any number of additional optional ingredients. These include conventional detergent composition components such as enzymes and enzyme stabilizing agents, suds boosters or suds suppressors, anti-tarnish and anticorrosion agents, bleaching agents, soil suspending agents, soil release agents, germicides, pH adjusting agents, non-builder alkalinity sources, chelating agents, organic and inorganic fillers, solvents, hydrotropes, optical brighteners, dyes and perfumes. One preferred additive is carboxy methyl cellulose, most preferably in a concentration of from about 0.01% to about 5% by weight of the detergent composition.

pH adjusting agents may be necessary in certain applications where the pH of the wash solution is greater than about 10.0 because the fabric integrity benefits of the defined compositions begin to diminish at a higher pH. Hence, if the wash solution is greater than about 10.0 after the addition of the fabric enhancing component of the present invention a pH adjuster should be used to reduce the pH of the washing solution to below about 10.0, preferably to a pH of below about 9.5 and most preferably below about 7.5. Suitable pH adjusters will be known to those skilled in the art.

A preferred optional ingredients for incorporation into the detergent compositions herein comprises a bleaching agent, e.g., a peroxygen bleach. Such peroxygen bleaching agents may be organic or inorganic in nature. Inorganic peroxygen bleaching agents are frequently utilized in combination with a bleach activator.

Useful organic peroxygen bleaching agents include percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, Issued Nov. 20, 1984; European Patent Application EP-A-133,354, Banks et al., Published Feb. 20, 1985; and U.S. Pat. No. 4,412,934, Chung et al., Issued Nov. 1, 1983. Highly preferred bleaching agents also include 6-nonylamino-6-oxoperoxycaproic acid (NAPAA) as described in U.S. Pat. No. 4,634,551, Issued Jan. 6, 1987 to Burns et al.

Inorganic peroxygen bleaching agents may also be used, generally in particulate form, in the detergent compositions herein. Inorganic bleaching agents are in fact preferred. Such inorganic peroxygen compounds include alkali metal perborate and percarbonate materials. For example, sodium perborate (e.g. mono- or tetra-hydrate) can be used. Suitable inorganic bleaching agents can also include sodium or potassium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used. Frequently inorganic peroxygen bleaches will be coated with silicate, borate sulfate or water-soluble surfactants. For example, coated percarbonate particles are available from various commercial sources such as FMC, Solvay Interox, Tokai Denka and Degussa.

Inorganic peroxygen bleaching agents, e.g., the perborates, the percarbonates, etc., are preferably combined with bleach activators, which lead to the in situ production in aqueous solution (i.e., during use of the compositions herein for fabric laundering/bleaching) of the peroxy acid corresponding to the bleach activator. Various non-limiting examples of activators are disclosed in U.S. Pat. No. 4,915,854, Issued Apr. 10, 1990 to Mao et al.; and U.S. Pat. No. 4,412,934 Issued Nov. 1, 1983 to Chung et al. The nonanoyloxybenzene sulfonate (NOBS) and tetraacetyl ethylene diamine (TAED) activators are typical and preferred. Mixtures thereof can also be used. See also the hereinbefore referenced U.S. Pat. No. 4,634,551 for other typical bleaches and activators useful herein.

Other useful amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenol sulfonate.

Preferred examples of bleach activators of the above formulae include (6-octanamido-caproyl) oxybenzenesulfonate, (6-nonanamidocaproyl) oxybenzene-sul-fonate, (6-decanamido-caproyl)oxybenzenesulfonate and mixtures thereof as described in the hereinbefore referenced U.S. Pat. No. 4,634,551.

Another class of useful bleach activators comprises the benzoxazin-type activators disclosed by Hodge et al. in U.S. Pat. No. 4,966,723, Issued Oct. 30, 1990, incorporated herein by reference. See also U.S. Pat. No. 4,545,784, Issued to Sanderson, Oct. 8, 1985, incorporated herein by reference, which discloses acyl caprolactams, including benzoyl caprolactam, adsorbed into sodium perborate.

If utilized, peroxygen bleaching agent will generally comprise from about 2% to 30% by weight of the detergent compositions herein. More preferably, peroxygen bleaching agent will comprise from about 2% to 20% by weight of the compositions. Most preferably, peroxygen bleaching agent will be present to the extent of from about 3% to 15% by weight of the compositions herein. If utilized, bleach activators can comprise from about 2% to 10% by weight of the detergent compositions herein. Frequently, activators are employed such that the molar ratio of bleaching agent to activator ranges from about 1:1 to 10:1, more preferably from about 1.5:1 to 5:1.

Additional suitable bleaching agents and bleach activators are disclosed in co-pending PCT Application WO98/19143, Published Mar. 25, 1999, entitled Laundry Detergent Compositions with Cyclic Amine Based Polymers to Provide Appearance and Integrity Benefits to Fabrics Laundered Therewith, which was filed on Sep. 15, 1997, in the name of Panandiker et al. [P&G Case No. 6834]. The entire disclosure of the Panandiker et al. reference was incorporated by reference above.

Another highly preferred optional ingredient in the detergent compositions herein is a detersive enzyme component. Enzymes can be included in the present detergent compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, cellulases, peroxidases, and mixtures thereof of any suitable origin, such as vegetable, animal, bacterial, fungal and yeast origin. Preferred selections are influenced by factors such as pH-activity and/or stability, optimal thermostability, and stability to active detergents, builders and the like. In this respect bacterial or fungal enzymes are preferred, such as bacterial amylases and proteases, and fungal cellulases.

"Detersive enzyme", as used herein, means any enzyme having a cleaning, stain removing or otherwise beneficial effect in a laundry detergent composition. Preferred enzymes for laundry purposes include, but are not limited to, proteases, cellulases, lipases, amylases and peroxidases.

Enzymes are normally incorporated into detergent compositions at levels sufficient to provide a "cleaning-effective amount". The term "cleaning-effective amount" refers to any amount capable of producing a cleaning, stain removal, soil removal, whitening, deodorizing, or freshness improving effect on substrates such as fabrics. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition. Higher active levels may be desirable in highly concentrated detergent formulations.

Cellulases usable herein include those disclosed in U.S. Pat. No. 4,435,307. Barbesgoard et al., Mar. 6, 1984, and GB-A-2.075.028; GB-A-2.095.275 and DE-OS-2.247.832. CAREZYME® and CELLUZYME® (Novo) are especially useful. See also WO 9117243 to Novo.

The enzyme-containing compositions herein may optionally also comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

F) Detergent Composition Preparation

The detergent compositions according to the present invention can be in liquid, paste or granular form. Such compositions can be prepared by combining the essential and optional components in the requisite concentrations in any suitable order and by any conventional means. The forgoing description of uses for the fabric enhancing component is intended to be exemplary and other uses will be apparent to those skilled in the art and are intended to be within the scope of the present invention.

Granular compositions, for example, are generally made by combining base granule ingredients, e.g., surfactants, builders, water, etc., as a slurry, and spray drying the resulting slurry to a low level of residual moisture (5–12%). The remaining dry ingredients, e.g., granules of the essential fabric enhancing component can be admixed in granular powder form with the spray dried granules in a rotary mixing drum. The liquid ingredients, e.g., solutions of the essential fabric enhancing component, enzymes, binders and perfumes, can be sprayed onto the resulting granules to form the finished detergent composition. Granular compositions according to the present invention can also be in "compact form", i.e. they may have a relatively higher density than conventional granular detergents, i.e. from 550 to 950 g/l. In such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt.

Liquid detergent compositions can be prepared by admixing the essential and optional ingredients thereof in any desired order to provide compositions containing components in the requisite concentrations. Liquid compositions according to the present invention can also be in "compact form", in such case, the liquid detergent compositions according to the present invention will contain a lower amount of water, compared to conventional liquid detergents. Addition of the fabric enhancing component to liquid detergent or other aqueous compositions of this invention may be accomplished by simply mixing into the liquid solutions the desired fabric enhancing component.

G) Fabric Laundering Method

The present invention also provides a method for laundering fabrics in a manner which imparts fabric appearance benefits provided by the fabric enhancing component used herein. Such a method employs contacting these fabrics with an aqueous washing solution formed from an effective amount of the detergent compositions hereinbefore described or formed from the individual components of such compositions. Contacting of fabrics with washing solution will generally occur under conditions of agitation although the compositions of the present invention may also be used to form aqueous unagitated soaking solutions for fabric cleaning and treatment. As discussed above, it is preferred that the washing solution have a pH of less than about 10.0, preferably it has a pH of about 9.5 and most preferably it has a pH of about 7.5.

Agitation is preferably provided in a washing machine for good cleaning. Washing is preferably followed by drying the wet fabric in a conventional clothes dryer. An effective amount of a high density liquid or granular detergent composition in the aqueous wash solution in the washing machine is preferably from about 500 to about 7000 ppm, more preferably from about 1000 to about 3000 ppm.

H) Fabric Conditioning and Softening

The fabric enhancing component hereinbefore described as components of the laundry detergent compositions herein may also be used to treat and condition fabrics and textiles in the absence of the surfactant and builder components of the detergent composition embodiments of this invention. Thus, for example, a fabric conditioning composition comprising only the fabric enhancing component, or comprising an aqueous solution of the fabric enhancing component may be added during the rinse cycle of a conventional home laundering operation in order to impart the desired fabric appearance and integrity benefits hereinbefore described.

Additional suitable fabric softening agents are disclosed in co-pending PCT Application WO98/19143, Published Mar. 25, 1999, entitled Laundry Detergent Compositions with Cyclic Amine Based Polymers to Provide Appearance and Integrity Benefits to Fabrics Laundered Therewith, which was filed on Sep. 15, 1997, in the name of Panandiker et al. [P&G Case No. 6834]. The entire disclosure of the Panandiker et al. reference was incorporated by reference above The compositions of the present invention comprise at least about 1%, preferably from about 10%, more preferably from about 20% to about 80%, more preferably to about 60% by weight, of the composition of one or more fabric softener actives.

EXAMPLES

The following examples illustrate the compositions and methods of the present invention, but are not necessarily meant to limit or otherwise define the scope of the invention.

EXAMPLE 1

Synthesis of the adduct of imidazole and epichlorohydin (Ratio of imidazole:epichlorohydrin 1:1):

The polycationic condensate is prepared by reacting imidazole and epichlorohydrin. To a round bottomed flask equipped with a magnatic stirrer, condenser and a thermometer are added imidazole (0.68 moles) and 95 mL water. The solution is heated to 50° C. followed by dropwise addition of epichlorohydrin (0.68 moles). After all the epichlorohydrin is added, the temperature is raised to 80° C. until all the alkylating agent is consumed. The condensate produced had molecular weight of about 12,500.

EXAMPLE 2

Synthesis of the adduct of imidazole and epichlorohydin (Ratio of imidazole:epichlorohydrin 1.4:1)

To a round bottomed flask equipped with a magnatic stirrer, condenser and a thermometer are added imidazole (0.68 moles) and 95 mL water. The solution is heated to 50° C. followed by dropwise addition of epichlorohydrin (0.50 moles). After all the epichlorohydrin is added, the temperature is raised to 80° C. until all the alkylating agent is consumed. The condensate produced had molecular weight of about 2000.

EXAMPLE 3

Synthesis of the adduct of piperazine, morpholine and epichlorohydin (Ratio 1.8/0.8/2.0)

Into a round bottom flask equipped with stirrer, thermometer, dropping funnel and reflux condenser 154.8 g (1.8 mole) of piperazine and 69.6 g (0.8 mole) of morpholine and 220 ml of water are added. After a clear solution at 40° C. is obtained, the solution is heated to 55–65° C. and with vigorous stirring 185 g (2 mole) of epichlorohydrin is added at such a rate, that the temperature does not exceed 80° C. After all the epichlorohydrin is added the reaction mixture is heated to 85° C. until all of the alkylating agents is consumed (negative Preussmann test after 4 hours). 108.8 g (0.68 mole) of 25% NaOH and 40 g of water are added and the reaction mixture is stirred for another hour at 85° C. Then an additional 47 g of water is added and the mixture is allowed to cool to room temperature.

EXAMPLE 4

Synthesis of the adduct of piperazine/morpholine/epi, in a ratio of 1.8/0.8/2.0

Into a round bottom flask equipped with stirrer, thermometer, dropping funnel and reflux condenser 154.8 g (1.8 mole) of piperazine and 69.6 g (0.8 mole) of morpholine and 220 ml of water are added. After a clear solution at 40° C. is obtained, the solution is heated to 55–65° C. and with vigorous stirring 185 g (2 mole) of epichlorohydrin is added at such a rate, that the temperature does not exceed 80° C. After all the epichlorohydrin is added the reaction mixture is heated to 85° C. until all of the alkylating agents has been consumed (negative Preussmann test after 4 hours). 108.8 g (0.68 mole) of 25% NaOH and 40 g of water is added and the reaction mixture is stirred for another hour at 85° C. Then an additional 47 g of water are added and the mixture is allowed to cool to room temperature.

EXAMPLE 5

Adduct of piperazine/morpholine/epi from Example 4, 100% oxidized 233.6 g (equivalent to 1,292 mole oxidizable nitrogen atoms) of the material from Example 4 above is mixed with 22.1 g (0.276) of 50% NaOH and then heated to 55–65° C. At that temperature 102.4 g (1,421 mole) of H2O2 (47.2%) is added, dropwise over a period of 3.5 hours. After the addition is complete, the reaction mixture is held at the same temperature for 3 more hours and is then stirred at room temperature overnight. Pt/C was added, unreacted H2O2 destroyed and the solution then filtered.

The reaction product is characterized as follows:

| | |
|---|---|
| water content | 58% |
| pH | 5.6 |
| chloride content | 1.593 mmole/g |

EXAMPLE 6

Synthesis of the adduct of imidazole/piperazine/epi, in a ratio 1.0/3.0/4.0

68.8g (1.0 mole) of limidazole and 260.6 g (3.0 mole) of piperazine are dissolved in 700.2 g of water and at a temperature of 50–60° C., 370 g (4.0 mole) of epichlorhydrin is added dropwise. After the addition is complete, the reaction mixture is stirred for additional 5 hours at 80° C.

EXAMPLE 7

Adduct of imidazole/piperazine/epi from Example 6, 100% oxidized

To 237 g of the product from Example 6 above (equivalent to 1,022 mole of oxidizable nitrogen atoms) 80.7 g (1.12 mole) of a 47.2% solution of H2O2 in water is added over a period of 5 hours at 40° C. After that, the mixture is heated to 50–60° C. until the theoretical amount of H2O2 has been consumed. Unreacted H2O2 is destroyed by using Pt/C and the solution is then filtered.

The reaction product is characterized as follows:

| | |
|---|---|
| water content: | 58.6% |
| pH: | 2.86 |
| chloride content: | 3.694 mmole/g |
| Mn (GPC): | 340 |
| Mw (GPC): | 940 |
| Mn/Mw: | 2.8 +/− 0.1 |

EXAMPLE 8

Synthesis of hydrophobically modified CMC Materials

The carboxylation of cellulose to produce CMC is a procedure that is well known to those skilled in the art. One method of producing the modified CMC materials of this invention, is to add during the CMC making process the material, or materials, to be substituted. An example of such as procedure is given below. This same procedure can be utilized with the other substituent materials described herein by replacing the hexylchloride with the substituent material, or materials, of interest, for example, cetylchloride. The amount of material that should be added to the CMC making process to achieve the desired degree of substitution will be easily calculated by those skilled in the art in light of the following Examples.

EXAMPLE 9

Synthesis of Hexylether of CMC

This example illustrates the preparation of a hydrophobically modified carboxymethyl cellulose and is representative of preparation of all of the cellulose ether derivatives of this invention.

Cellulose (20 g), sodium hydroxide (10 g), water (30 g), and ethanol (150 g) are charged into a 500 ml glass reactor. The resulting alkali cellulose is stirred 45 minutes at 25° C. Then monochloroacetic acid (15 g) and hexylchoride (1 g) are added and the temperature raised over time to 95° C. and held at 95° C. for 150 minutes. The reaction is cooled to 70° C., and then cooled to 25° C. Neutralization is accomplished by the addition of a sufficient amount of nitric acid/acetic acid to achieve a slurry pH of between 8 and 9. The slurry is filtered to obtain a hexylether of CMC.

EXAMPLE 10

Cellulosic Polymers Used in Test Detergent Compositions

Representative modified cellulosic polymers for use in the liquid and granular detergent compositions described below are characterized in Tables 10 A and 10 B. The General Polymer Parameters are common to all of the polymers, while the specific chemical structure of the materials tested are listed under the Specific Polymer Parameters.

TABLE 10 A

General Polymer Parameters

| Molecular Parameters | Description |
|---|---|
| Polymer Backbone | Carboxymethylcellulose |
| Degree of Carboxymethylation | $DS_{RC}$ = 0.3–2.0; preferred $DS_{RC}$ = 0.5–0.70 |
| Distribution of Carboxymethyls | Even and random distribution of carboxylmethyls along the backbone |
| Molecular Weight | Mw: 5,000–2,000000. Preferred: medium (approx 250,000 g/mol) |
| Type of Modification | Ether modification (in addition to carboxymethylation). Mixed cellulose ether |
| Level of Modification | $DS_{RH}$ = about 0.001 to about 0.1 |

TABLE 10 B

Table Specific Polymer Parameters

| ID | Polymer | Type of Modification*** | Types of Chemistry |
|---|---|---|---|
| *A | Hexyl CMC | Hexyl ether | Chlorohexane added to CMC making process |
| *B | Decyl CMC | Decyl ether | Chlorodecane added to CMC making process |
| *C | C12–C13 alkoxy-2 hydroxypropyl CMC | C12–C13 alkoxy-2 hydroxypropyl ether | C12–C13 alkyl glycidyl ether added to CMC making process |
| *D | Hexadecyl CMC | Hexadecyl ether | Chlorohexadecane added to CMC making process |
| *E | Chloride salt of 3-trimethyl-ammonio-2-hydroxy-propyl ether of CMC | chloride salt of 3-trimethyl-ammonio-2-hydroxy-propyl ether | 2,3-epoxypropyltrimethyl ammonium chloride added to the CMC making process |

TABLE 10 B-continued

Table Specific Polymer Parameters

| ID | Polymer | Type of Modification*** | Types of Chemistry |
|---|---|---|---|
| *F | [—(C(O)—CH(Cl6H33)—C(O)CH2(Cl6H33)] ester of CMC or 1,3-dioxo-2-hexadecyloctadecyl ester of CMC | | Cetyl Ketene Dimer added to CMC making process. |

CMC = Carboxymethylcellulose
*Manufactured by Metsa Specialty Chemicals
**Manufactured by Akzo
***$DS_{RM}$ for these materials was in the range of from about 0.001 to about 0.1

EXAMPLE 11

The following are idealized chemical structures for certain cyclic amine based polymers, oligomers or copolymers of this invention. Side reactions expected to occur during the condensation are not shown.

TABLE 11

| Example | Material |
|---|---|
| 1 | Adduct of Imidazole-epichlorohydrin (Ratio of imidazole:epichlorohydrin 1:1, Polymer from Example 1) 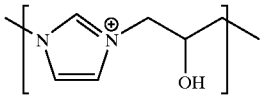 (Idealized Structure) |
| 2 | Adduct of Imidazole-epichlorohydrin (Ratio of imidazole:epichlorohydrin 1.36:1, Polymer from Example 2) 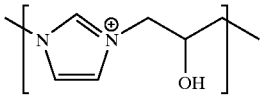 (Idealized Structure) |
| 3 | Adduct of Imidazole-epichlorohydrin (Ratio of imidazole:epichlorohydrin 1.75:1) 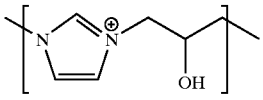 (Idealized Structure) |
| 4 | Adduct of Imidazole-epichlorohydrin-trisglycidyl ether from glycerine (Ratio of imidazole:epichlorohydrin: trisglycidylether 2.0:1.76:0.26) 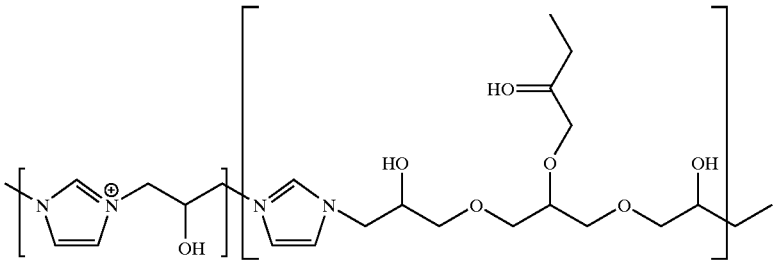 Idealized Structure |

TABLE 11-continued

| Example | Material |
|---|---|
| 5 | Adduct of Imidazole-epichlorohydrin-trisglycidyl ether from glycerine (Ratio of imidazole:epichlorohydrin: -trisglycidyl ether from glycerine 2.0:1.9:0.1) |
| 6 | Adduct of piperazine and epichlorohydrin (ratio 1:1) |
| 7 | Adduct of piperazine and epichlorohydrin (ratio 1:1) benzyl quat |
| 8 | Adduct of piperazine and epichlorohydrin (ratio 1:1) methyl quat |
| 9 | Adduct of piperazine, morpholine and epichlorohydrin (ratio 0.9:0.4:1.0) |
| 10 | Adduct of piperazine, piperidine and epichlorohydrin (ratio 0.9:0.4:1.0) |
| 11 | Adduct of piperazine, morpholine and epichlorohydrin (ratio 0.9:0.4:1.0) methyl quat |

TABLE 11-continued

| Example | Material |
|---|---|
| 12 | Adduct of piperazine, piperidine and epichlorohydrin (ratio 0.9:0.4:1.0) methyl quat |
| | 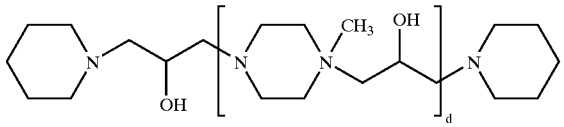 |
| 13 | Adduct of piperazine, morpholine and epichlorohydrin (ratio 0.9:0.4:1.0) benzyl quat |
| | 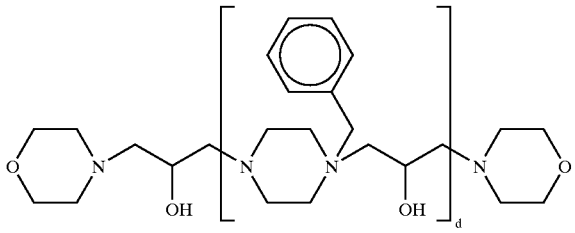 |
| 14 | Adduct of piperazine, piperidine and epichlorohydrin (ratio 0.9:0.4:1.0) benzyl quat |
| | 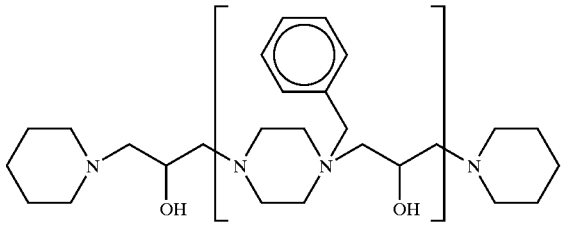 |
| 15 | Adduct of imidazole, piperazine and epichlorohydrin (ratio 2:1:3) |
| | 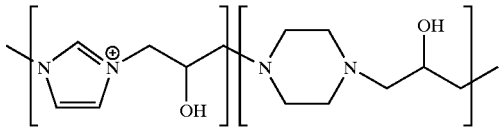 |
| 16 | Adduct of imidazole, piperazine and epichlorohydrin (ratio 1:1:2) |
| | 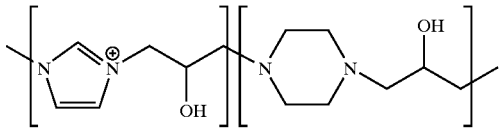 |
| 17 | Adduct of imidazole, 1,6 diaminohexane and epichlorohydrin (ratio 1:1:2) |
| | 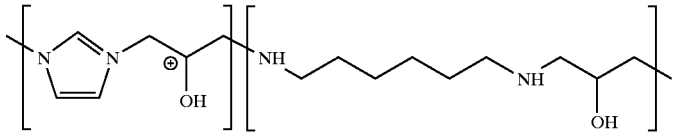 |
| 18 | Adduct of imidazole, dimethylaminopropylamine and epichlorohydrin (ratio 1.02:0.34:1.0) |
| | 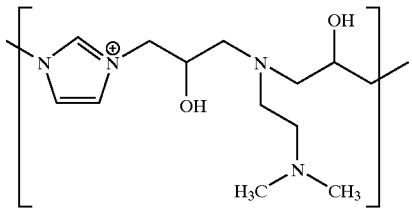 |

TABLE 11-continued

| Example | Material |
|---|---|
| 19 | Adduct of imidazole-epichlorohydrin and chloroacetic acid (Ratio-1.36:0.97:0.07) |
| | 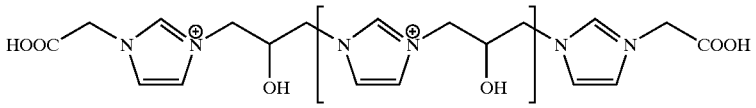 |
| 20 | Adduct of imidazole-epichlorohydrin and chloroacetic acid (Ratio-1.36:0.93:0.14) |
| | 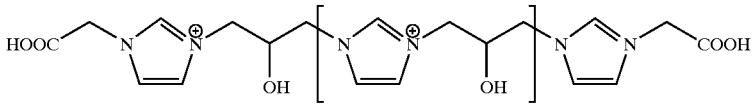 |
| 21 | Adduct of imidazole-epichlorohydrin and chloroacetic acid (Ratio-1.36:0.83:0.34) |
| | 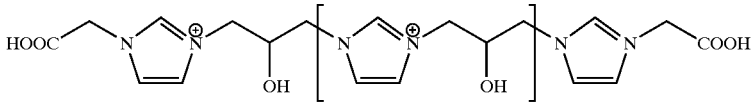 |
| 22 | Adduct of imidazole-epichlorohydrin and 3chlorohydroxypropyl sulfonic acid (ratio: 1.0:0.83:0.34) |
| | 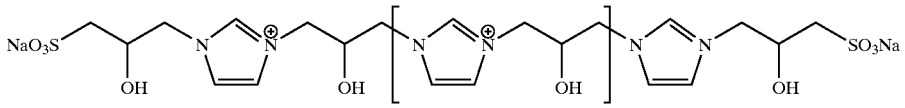 |
| 23 | Adduct of imidazole-epichlorohydrin and 3 chlorohydroxypropyl sulfonic acid (ratio: 1.0:0.75:0.5) |
| | 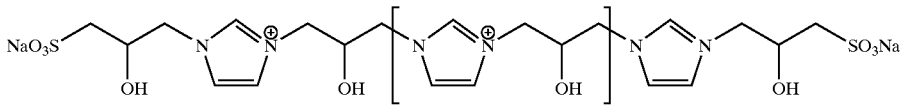 |
| 24 | Adduct of imidazole, piperazine and epichlorohydrin (Ratio- 1.0:1.0:2.0) quat with 0.22 moles of chloroacetate |
| | 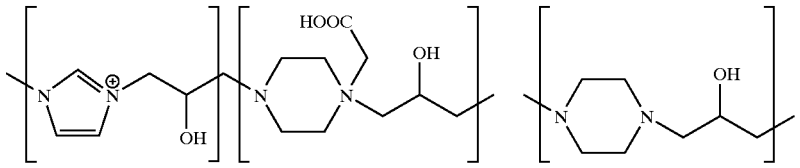 |
| 25 | Adduct of imidazole, piperazine and epichlorohydrin (Ratio- 1.0:3.0:4.0) quat with 0.32 moles of chloroacetate |
| | 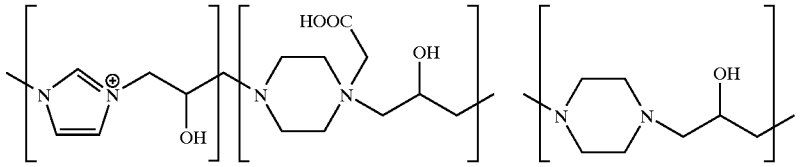 |
| 26 | Adduct of imidazole, piperazine and epichlorohydrin (Ratio- 1.0:1.0:2.0) quat with 0.45 moles of chloroacetate |
| | 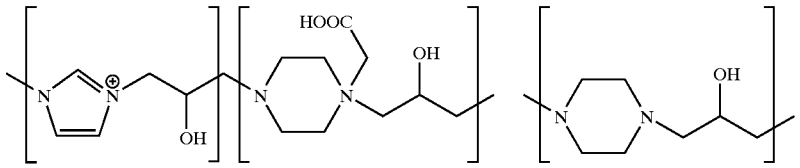 |

TABLE 11-continued

| Example | Material |
|---|---|
| 27 | Adduct of imidazole and epichlorohdrin, (ratio 1.75:1) oxidized |
| | 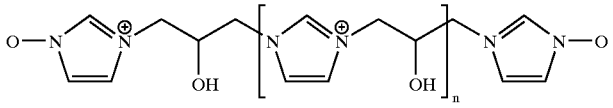 |
| 28 | Adduct of piperazine and epichlorohydrin (ratio 1:1) 100% oxidized |
| | 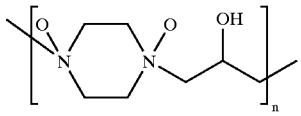 |
| 29 | Adduct of piperazine and epichlorohydrin (ratio 1:1) 50% oxidized |
| | 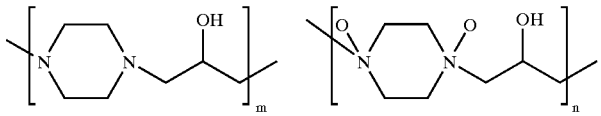 |
| 30 | Adduct of piperazine, morpholine and epichlorohydrin (ratio 1:0.2:1) 100% oxidized |
| | 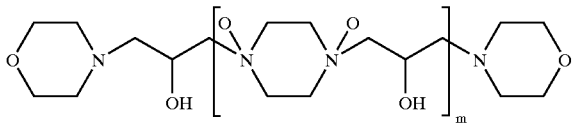 |
| 31 | Adduct of piperazine, morpholine and epichlorohydrin (ratio 1:0.2:1) 25% methyl quat and oxidized |
| | 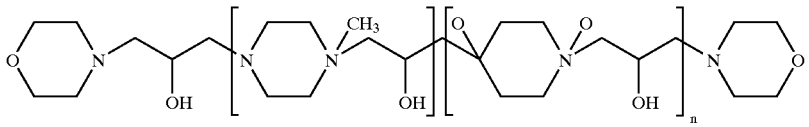 |
| 32 | Adduct of imidazole, piperazine and epichlorohydrin (ratio 1:3;4) 100% oxidized |
| | 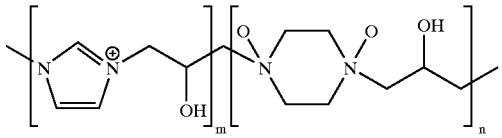 |
| 33 | Adduct of imidazole, piperazine and epichlorohydrin (ration 1:3;4) 50% oxidized |
| | 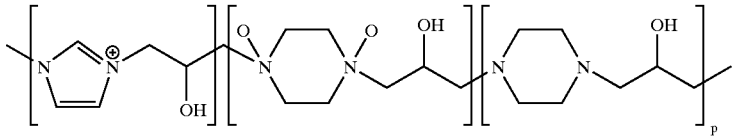 |
| 34 | Adduct of imidazole, piperazine and epichlorohydrin (ration 1:1:2) 100% oxidized |
| | 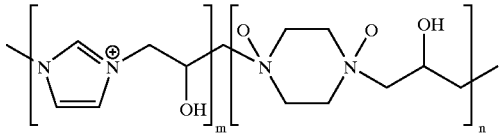 |

TABLE 11-continued

| Example | Material |
|---|---|
| 35 | Adduct of imidazole, piperazine and epichlorohydrin (ration 1:5:6) 100% oxidized |

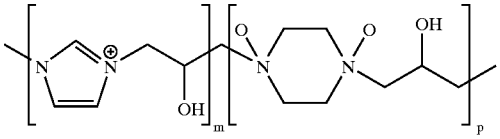

| | |
|---|---|
| 36 | Adduct of imidazole, piperazine and epichlorohydrin (ration 1:10:11) 100% oxidized |

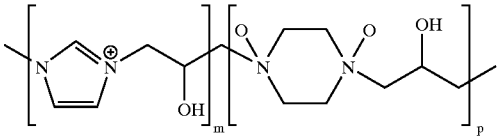

| | |
|---|---|
| 37 | Adduct of imidazole, piperazine and epichlorohydrin (Ratio- 1.0:3.0:4.0) quat with 0.32 moles of chloroacetate and oxidized |

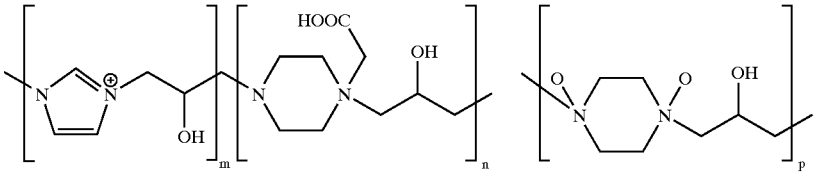

| | |
|---|---|
| 38 | Adduct of imidazole, piperazine and epichlorohydrin (Ratio- 1.0:1.0:2.0) quat with 0.45 moles of chloroacetate and oxidized |

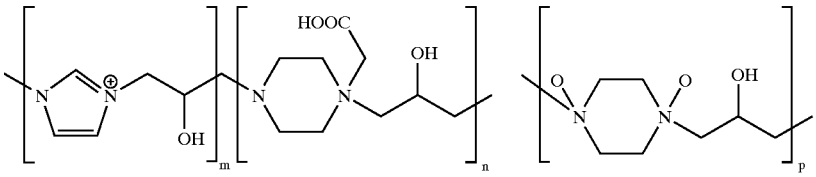

| | |
|---|---|
| 39 | Adduct of imidazole, piperazine and epichlorohydrin (Ratio- 1.0:5.0:6.0) quat with 0.32 moles of chloroacetate and oxidized |

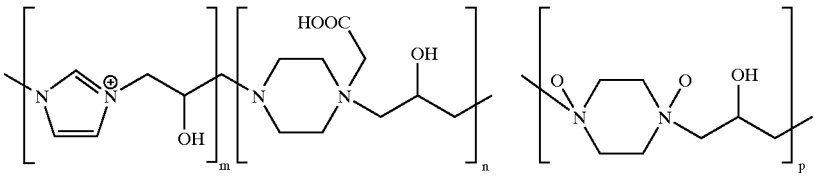

| | |
|---|---|
| 40 | Adduct of imidazole, piperazine and epichlorohydrin (Ratio- 1.0:1.0:2.0) quat with 0.45 moles of dimethyl sulfate and oxidized |

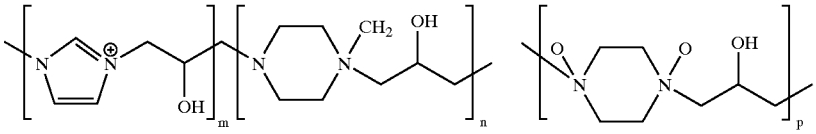

TABLE 11-continued

| Example | Material |
|---|---|
| 41 | Adduct of imidazole, dimethylaminopropylamine and epichlorohydrin (ratio 1.02:0.34:1.0) oxidized |

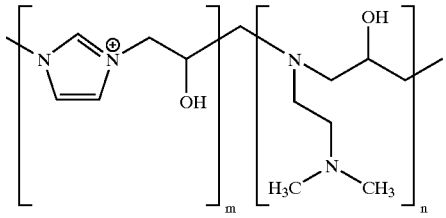

EXAMPLE 12

Granular Detergent Test Composition Preparation

Several heavy duty granular detergent compositions are prepared containing a fabric enhancing component. These granular detergent compositions all have the following basic formula:

TABLE 12

| Component | Wt. % |
|---|---|
| $C_{12}$ Linear alkyl benzene sulfonate | 9.31 |
| $C_{14-15}$ alkyl ether (0.35 EO) sulfate | 12.74 |
| Zeolite Builder | 27.79 |
| Sodium Carbonate | 27.31 |
| PEG 4000 | 1.60 |
| Disperant | 2.26 |
| $C_{12-13}$ Alcohol Ethoxylate (9 EO) | 1.5 |
| Sodium Perborate | 1.03 |
| Soil Release Polymer | 0.41 |
| Enzymes | 0.59 |
| Cyclic Amine Based Polymers or Oligomers | 3.0 |
| Hydrophobically Modified Cellulosic Based Polymers or Oligomers | 1.0 |
| Perfume, Brightener, Suds Suppressor, Other Minors, Moisture, Sulfate | Balance |
| | 100% |

EXAMPLE 13

Liquid Detergent Test Composition Preparation

Several heavy duty liquid detergent compositions are prepared comprising a fabric enhancing component of this invention. These liquid detergent compositions all have the following basic formula:

TABLE 13

| Component | Wt. % |
|---|---|
| $C_{12-15}$ alkyl ether (2.5) sulfate | 38 |
| $C_{12}$ glucose amide | 6.86 |
| Citric Acid | 4.75 |
| $C_{12-14}$ Fatty Acid | 2.00 |
| Enzymes | 1.02 |
| MEA | 1.0 |
| Propanediol | 0.36 |
| Borax | 6.58 |
| Dispersant | 1.48 |
| Na Toluene Sulfonate | 6.25 |
| Cyclic Amine Based Polymers or Oligomers | 1.0 |
| Hydrophobically Modified Cellulosic Based Polymers or Oligomers | 0.1 |
| Dye, Perfume, Brighteners, Preservatives, Suds Suppressor, Other Minors, Water | Balance |
| | 100% |

EXAMPLE 14

Granular Detergent Test Composition Preparation

Several granular detergent compositions are prepared containing a fabric enhancing component. Such granular detergent compositions all have the following basic formula:

TABLE 14

| Component | Example Wt. % | Comparative Wt. % |
|---|---|---|
| Na $C_{12}$ Linear alkyl benzene sulfonate | 9.40 | 9.40 |
| Na $C_{14-15}$ alkyl sulfonate | 11.26 | 11.26 |
| Zeolite Builder | 27.79 | 27.79 |
| Sodium Carbonate | 27.31 | 27.31 |
| PEG 4000 | 1.60 | 1.60 |
| Dispersant, Na polyacrylate | 2.26 | 2.26 |
| $C_{12-13}$ alkyl ethoxylate (E9) | 1.5 | 1.5 |
| Sodium Perborate | 1.03 | 1.03 |
| Cyclic Amine Based Polymers or Oligomers | 0.8 | 0 |
| Hydrophobically Modified Cellulosic Based Polymers or Oligomers | 0.3 | 0 |
| Other Adjunct ingredients | Balance | Balance |
| | 100% | 100% |

What is claimed is:

1. A detergent composition comprising:

from about 1% to about 80% by weight of surfactants selected from the group consisting of nonionic, anionic, cationic, amphoteric, zwitterionic surfactants and mixtures thereof; and from about 0.01% to about 5.0% by weight of a fabric enhancing component which comprises a mixture of an ingredient selected from the group consisting of cyclic amine based polymers, oligomers or copolymers, and an ingredient selected from the group consisting of hydrophobically modified cellulosic based polymers or oligomers; and wherein the detergent composition is contained within an interior chamber of a container, the container further comprising an exterior surface wherein the exterior surface contains a description of the composition comprising language selected from the group consisting of: helps clothes look healthier, helps stop wear before it starts, maintains the appearance of clothes, helps prevent clothes from looking worn out, strengthens while it cleans for better looking clothes, strengthens threads so clothes look better, helps prevent clothes from looking worn, helps prevent wear and tear in the washer that can make clothes look old, helps keep clothes from aging, helps clothes come out of the washer looking as good as when they went in, helps preserve the fabric integrity of clothes, strengthens threads from the inside out for better looking clothes, extends the life of clothes, is like a vitamin for clothes, works like an anti-aging product on clothes, is like calcium for clothes, is like a supplement for clothes, after just 10 washes clothes look better than they would if you washed them with other detergents, fortifies threads for healthier looking clothes, helps prevent clothes from looking old before their time, is like stopping time for your clothes so they stay looking good.

2. The detergent composition of claim 1, wherein the hydrophobically modified cellulosic based polymers or oligomers are of the general formula:

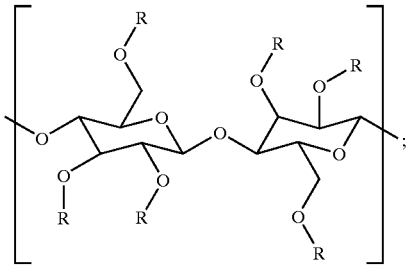

wherein each R is selected from the group consisting of $R_2$, $R_C$, and

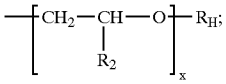

wherein:

each $R_2$ is independently selected from the group consisting of H and $C_1$–$C_4$ alkyl;

each $R_C$ is

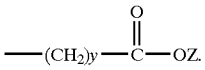

wherein each Z is independently selected from the group consisting of M, $R_2$, $R_C$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylaryloxy-2-hydroxyalkyl, $(R_4)_2N$-alkyl, $(R_4)_2N$-2-hydroxyalkyl, $(R_4)_3N$-alkyl, $(R_4)_3N$-2-hydroxyalkyl, $C_6$–$C_{12}$ aryloxy-2-hydroxyalkyl,

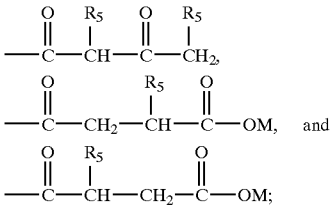

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminoalkyl, piperidinoalkyl, morpholinoalkyl, cycloalkylaminoalkyl and hydroxyalkyl;

each $R_5$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $(R_4)_2N$-alkyl, and $(R_4)_3N$-alkyl;

wherein:

M is a suitable cation selected from the group consisting of Na, K, 1/2Ca, and 1/2Mg;

each x is from 0 to about 5;

each y is from about 1 to about 5; and provided that:

the Degree of Substitution for group $R_H$ is between about 0.001 and 0.1;

the Degree of Substitution for group $R_C$ wherein Z is H or M is between about 0.2 and 2.0;

if any $R_H$ bears a positive charge, it is balanced by a suitable anion; and two $R_4$'s on the same nitrogen can together form a ring structure selected from the group consisting of piperidine and morpholine.

3. The detergent composition of claim 1, wherein the cyclic amine based polymers, oligomers or copolymers are of the general formula:

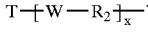

wherein;

each T is independently selected from the group consisting of H, $C_1$–$C_{12}$ alkyl, substituted alkyl, $C_7$–$C_{12}$ alkylaryl, —$(CH_2)_hCOOM$, —$(CH_2)_hSO_3M$, $CH_2CH(OH)SO_3M$, —$(CH_2)_hOSO_3M$,

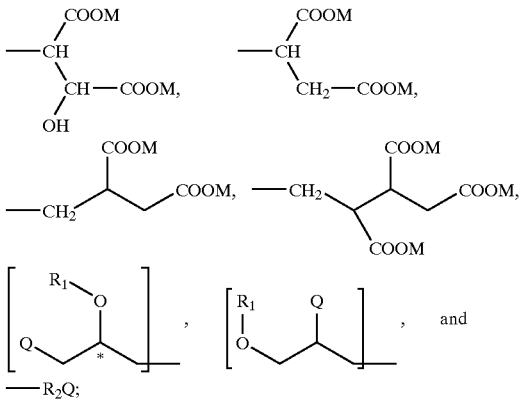

wherein W comprises at least one cyclic constituent selected from the group consisting of:

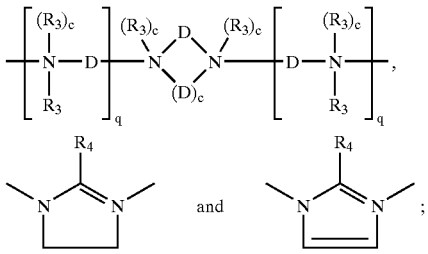

in addition to the at least one cyclic constituent, W may also comprise an aliphatic or substituted aliphatic moiety of the general structure;

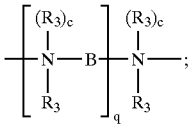

each B is independently $C_1$–$C_{12}$ alkylene, $C_1$–$C_{12}$ substituted alkylene, $C_3$–$C_{12}$ alkenylene, $C_8$–$C_{12}$ dialkylarylene, $C_8$–$C_{12}$ dialkylarylenediyl, and —$(R_5O)_nR_5$—;

each D is independently $C_2$–$C_6$ alkylene;

each Q is independently selected from the group consisting of hydroxy, $C_1$–$C_{18}$ alkoxy, $C_2$–$C_{18}$ hydroxyalkoxy, amino, $C_1$–$C_{18}$ alkylamino, dialkylamino, trialkylamino groups, heterocyclic monoamino groups and diamino groups;

each $R_1$ is independently selected from the group consisting of H, $C_1$–$C_8$ alkyl and $C_1$–$C_8$ hydroxyalkyl;

each $R_2$ is independently selected from the group consisting of $C_1$–$C_{12}$ alkylene, $C_1$–$C_{12}$ alkenylene, —$CH_2$—$CH(OR_1)$—$CH_2$, $C_8$–$C_{12}$ alkarylene, $C_4$–$C_{12}$ dihydroxyalkylene, poly($C_2$–$C_4$ alkyleneoxy)alkylene, $H_2CH(OH)CH_2OR_2OCH_2CH(OH)CH_2$—, and $C_3$–$C_{12}$ hydrocarbyl moieties;

provided that when $R_2$ is a $C_3$–$C_{12}$ hydrocarbyl moiety the hydrocarbyl moiety can comprise from about 2 to about 4 branching moieties of the general structure:

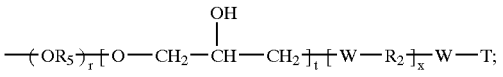

each $R_3$ is independently selected from the group consisting of H, O, $R_2$, $C_1$–$C_{20}$ hydroxyalkyl, $C_1$–$C_{20}$ alkyl, substituted alkyl, $C_6$–$C_{11}$ aryl, substituted aryl, $C_7$–$C_{11}$ alkylaryl, $C_1$–$C_{20}$ aminoalkyl, —$(CH_2)_nCOOM$, —$(CH_2)_nSO_3M$, $CH_2CH(OH)SO_3M$, —$(CH_2)_nOSO_3M$,

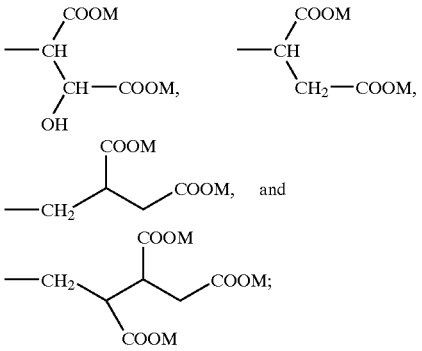

each $R_4$ is independently selected from the group consisting of H, $C_1$–$C_{22}$ alkyl, $C_1$–$C_{22}$ hydroxyalkyl, aryl and $C_7$–$C_{22}$ alkylaryl;

each $R_5$ is independently selected from the group consisting of $C_2$–$C_8$ alkylene, $C_2$–$C_8$ alkyl substituted alkylene; and A is a compatible monovalent or di or polyvalent anion;

M is a compatible cation;

b=number necessary to balance the charge;

each x is independently from 3 to about 1000;

each c is independently 0 or 1;

each h is independently from about 1 to about 8;

each q is independently from 0 to about 6;

each n is independently from 1 to about 20;

each r is independently from 0 to about 20; and each t is independently from 0 to 1.

4. The detergent composition of claim 1, wherein the cyclic amine based polymers, oligomers or copolymers are adducts selected from the group consisting of piperazine, piperadine, epichlorohydrin, epichlorohydrin benzyl quat, epichlorohydrin methyl quat, morpholine and mixtures thereof.

5. The detergent composition of claim 3, wherein each $R_1$ is H and at least one W is selected from the group consisting of:

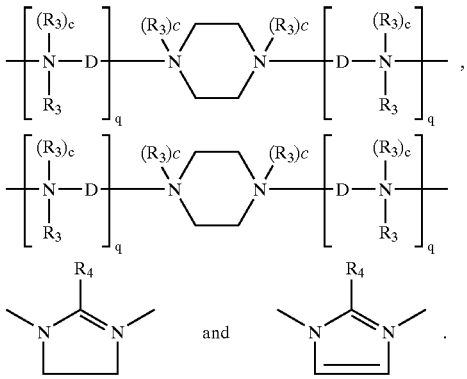

6. The detergent composition of claim 3, wherein each $R_1$ is H and at least one W is selected from the group consisting of:

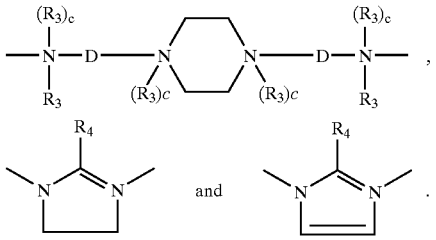

7. The detergent composition of claim 3, wherein each $R_1$ is H and at least one W is selected from the group consisting of:

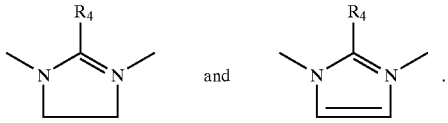

8. The detergent composition of claim 2, wherein each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylaryloxy-2-hydroxyalkyl, $(R_4)_2$N-alkyl, $(R_4)_2$N-2-hydroxyalkyl, $(R_4)_3$N-alkyl, $(R_4)_3$N-2-hydroxyalkyl, and $C_6$–$C_{12}$ aryloxy-2-hydroxyalkyl.

9. The detergent composition of claim 2, wherein each $R_H$ is independently selected from the group consisting of

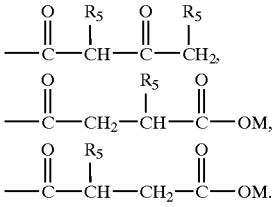

10. The detergent composition of claim 2, wherein the cellulosic based polymer or oligomer has an average molecular weight of from about 5,000 to about 2,000,000.

11. The detergent composition of claim 1, wherein the composition further comprises a detersive enzyme and optionally comprises an enzyme stabilization system.

12. The detergent composition of claim 1, wherein the composition further comprises an inorganic peroxygen bleaching compound, and a bleach activator.

13. The detergent composition of claim 1, wherein the composition further comprises a cellulase enzyme.

14. The detergent composition of claim 12, wherein the composition further comprises a cellulase enzyme.

15. The detergent composition of claim 1, further comprising carboxy methyl cellulose, in a concentration of from about 0.01% to about 5% by weight of the detergent composition.

16. The detergent composition of claim 12, wherein the bleach activator is nonanoyloxybenzene sulfonate.

17. A laundry additive composition comprising:

from about 1% to about 80% by weight of water; and from about 0.01% to about 5.0% by weight of a fabric enhancing component which comprises a mixture of an ingredient selected from the group consisting of cyclic amine based polymers, oligomers or copolymers, and an ingredient selected from the group consisting of hydrophobically modified cellulosic based polymers or oligomers; and wherein the laundry additive composition is contained within an interior chamber of a container, the container further comprising an exterior surface wherein the exterior surface contains a description of the composition comprising language selected from the group consisting of: helps clothes look healthier, helps stop wear before it starts, maintains the appearance of clothes, helps prevent clothes from looking worn out, strengthens while it cleans for better looking clothes, strengthens threads so clothes look better, helps prevent clothes from looking worn, helps prevent wear and tear in the washer that can make clothes look old, helps keep clothes from aging, helps clothes come out of the washer looking as good as when they went in, helps preserve the fabric integrity of clothes, strengthens threads from the inside out for better looking clothes, extends the life of clothes, is like a vitamin for clothes, works like an anti-aging product on clothes, is like calcium for clothes, is like a supplement for clothes, after just 10 washes clothes look better than they would if you washed them other detergents, fortifies threads for healthier looking clothes, helps prevent clothes from looking old before their time, is like stopping time for your clothes so they stay looking good.

18. The laundry additive composition of claim 17, wherein the composition further comprises a pH adjuster and one or more fabric softening components.

* * * * *